US006694948B2

(12) United States Patent
Glugla et al.

(10) Patent No.: US 6,694,948 B2
(45) Date of Patent: Feb. 24, 2004

(54) VACUUM MANAGEMENT SYSTEM ON A VARIABLE DISPLACEMENT ENGINE

(75) Inventors: Christopher Paul Glugla, Macomb, MI (US); John Ottavio Michelini, Sterling Heights, MI (US); Michael Flory, Plymouth, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 113 days.

(21) Appl. No.: 10/064,086

(22) Filed: Jun. 10, 2002

(65) Prior Publication Data

US 2003/0226543 A1 Dec. 11, 2003

(51) Int. Cl.[7] ..... F02D 13/00
(52) U.S. Cl. ..... 123/404; 123/90.15; 123/198 F
(58) Field of Search ..... 123/404, 402, 123/319, 90.15, 198 F

(56) References Cited

U.S. PATENT DOCUMENTS 1,755,318 A 4/1930 Dinesen
4,012,675 A 3/1977 Schulze, Jr.
4,249,374 A * 2/1981 Sugasawa et al. ..... 60/276
4,305,355 A * 12/1981 Jordan ..... 123/198 F
4,359,979 A * 11/1982 Dolza ..... 123/198 F
5,529,549 A 6/1996 Moyer
5,992,390 A 11/1999 Moyer
6,619,258 B2 * 9/2003 McKay et al. ..... 123/350

* cited by examiner

*Primary Examiner*—Bibhu Mohanty

(57) ABSTRACT

A vehicle reciprocating piston, variable displacement internal combustion engine arrangement 7 is provided. The arrangement 7 includes a first cylinder group 12. A second selectively deactivatable cylinder group 14 is also provided. A manifold 18 is provided which is exposed to at least one of the cylinder groups. A vacuum system 24 is powered by manifold 18. An engine controller 16 is cognizant of a vacuum level of the vacuum system 24. The controller modifies operation of the engine arrangement 7 to increase a vacuum level of the manifold 38 when the second cylinder group 14 is deactivated and the vacuum system 24 vacuum level is lower than a predetermined level

39 Claims, 3 Drawing Sheets

VACUUM MANAGEMENT SYSTEM ON A VARIABLE DISPLACEMENT ENGINE

BACKGROUND OF THE INVENTION

The present invention relates to an arrangement and method of control thereof of a reciprocating piston internal combustion engine utilized in a vehicle with vacuum powered components. In particular, the present invention relates to such a vehicle with a reciprocating piston variable displacement engine having selective cylinder deactivation.

Four-stroke, multiple-cylinder, reciprocating piston internal combustion engines used in automobiles are capable of being operated over great speed and load ranges. Those skilled in the art have recognized for years that lower specific fuel consumption is usually achieved when an engine is operated at a relatively high load. This is particularly true for spark ignition engines because throttling losses are minimized when the engine is operated at or near wide open throttle at full load conditions. Unfortunately, engines are frequently required to operate at less than maximum load. When an engine operates at partial load, fuel economy suffers because of the pumping loss. Therefore, it is desirable to avoid partial load operation of the engine.

Engines have been designed that avoid partial load operation by deactivating selected cylinder combustion chambers to allow the remaining active chambers to be operated at higher loads. Such engines are often referred to as variable displacement engines. Deactivation of the cylinders is typically achieved by a lost motion rocker arm assembly which can be selectively disabled, therefore allowing the valves associated with the given cylinder to remain in a deactivated closed position regardless of the position of an associated camshaft. At the time of a valve deactivation, the fuel injectors associated with the deactivated cylinders are also deactivated. Deactivation of cylinders may also be achieved by utilizing a variable cam timing unit to change the phase of operation of the exhaust or the intake valves.

As used in this application, the term "deactivated cylinder" may refer to a cylinder that is deactivated by a valve that is deactivated in an opened or closed position. "Deactivated cylinder" may also refer to a valve that is deactivated by its change of phase in relationship to the angular position of an engine crankshaft or to a cylinder deactivated by other means.

A further explanation of other schemes used in variable displacement engines with valve deactivation can be gained by a review of Russ, et al., U.S. Pat. No. 6,237,559, Stockhausen, et al., U.S. Pat. No. 5,642,703 and Stockhausen U.S. Pat. No. 5,467,748 commonly assigned.

On variable displacement engines, such as those which deactivate a bank of cylinders that have dual independent intake systems and dual independent throttle valves, it is often necessary to implement a vacuum control system. (See U.S. patent application Ser. No. 09/682,695 filed Oct. 5, 2001.) At light loads, the engine is typically operating with half its cylinders deactivated, to reduce engine throttle. Since the engine has less throttle on a particular bank of cylinders, the manifold pressure exposed to that bank will be higher. The disadvantage of operating in a deactivated mode for long periods of time is that systems that depend upon a vacuum force for power may not operate properly. Examples of such systems are the brake system master cylinder booster, vacuum actuated engine gas recirculation valve systems and heating, vacuum and air conditioning vent controls.

Prior to the present invention, the lack of vacuum to power systems was often addressed by using a hydraulic boost pump which worked off the power steering pump, or by having an electric powered vacuum pump. The use of a hydraulic or electric pump is typically undesirable since the hydraulic boost pump adds cost and weight to the vehicle and may be a source of parasitic power losses when not being utilized. The electric vacuum boost pump also adds an additional component, weight and cost to the vehicle.

It is desirable to provide an arrangement and method of operation thereof of a vehicle with a variable displacement engine wherein the vacuum system can be managed to ensure proper vacuum power ability without the addition of a hydraulic or electric boost pump.

SUMMARY OF INVENTION

In a preferred embodiment, the present invention provides an arrangement of a vehicle with a variable displacement engine having a first group of cylinders which are normally always activated and a second selectively valve deactivated group of cylinders. A sensor is provided in the vacuum system to alert the engine controller whenever the vacuum level within the vacuum system is below a predetermined desired value. The vacuum level can also be inferred by engine operational parameters or by vehicle brake system operational history. Upon recognition of a low vacuum level, the engine controller will modify the engine operation to raise the vacuum level.

The controller can sequentially or non-sequentially select among three main engine operational options to raise the vacuum level including: (1) the controller can advance the variable time caming on the first group of cylinders; and (2) the controller can cause one or more of the second group of cylinders to be valve activated to pump air from the engine manifold. Typically, such an engine will have independent control of dual throttles and the controller will additionally close the throttle that is operatively connected with the second group of cylinders. If options (1) and (2) are insufficient, the controller can additionally cause all or part of the fuel injectors of the second group of cylinders to resume operation and for the ignition system to fire the cylinder.

The present invention is advantageous in that it maintains proper vacuum level in a vacuum system without the requirement of additional hydraulic or electric pumps and the cost and weight associated with such systems.

It is an advantage of the present invention to provide an arrangement of an automotive vehicle having a variable displacement engine wherein the vacuum level of the vacuum system is maintained.

It is a further advantage of the present invention to do the above noted task without the additional cost and weight associated with a vacuum pump powered by the power steering pump of the vehicle or a separate vacuum pump which is electrically powered.

Other advantages and features of the present invention will be further realized from the review of the invention as it is disclosed in the detailed description and accompanying drawings.

DETAILED DESCRIPTION

Figure 1:
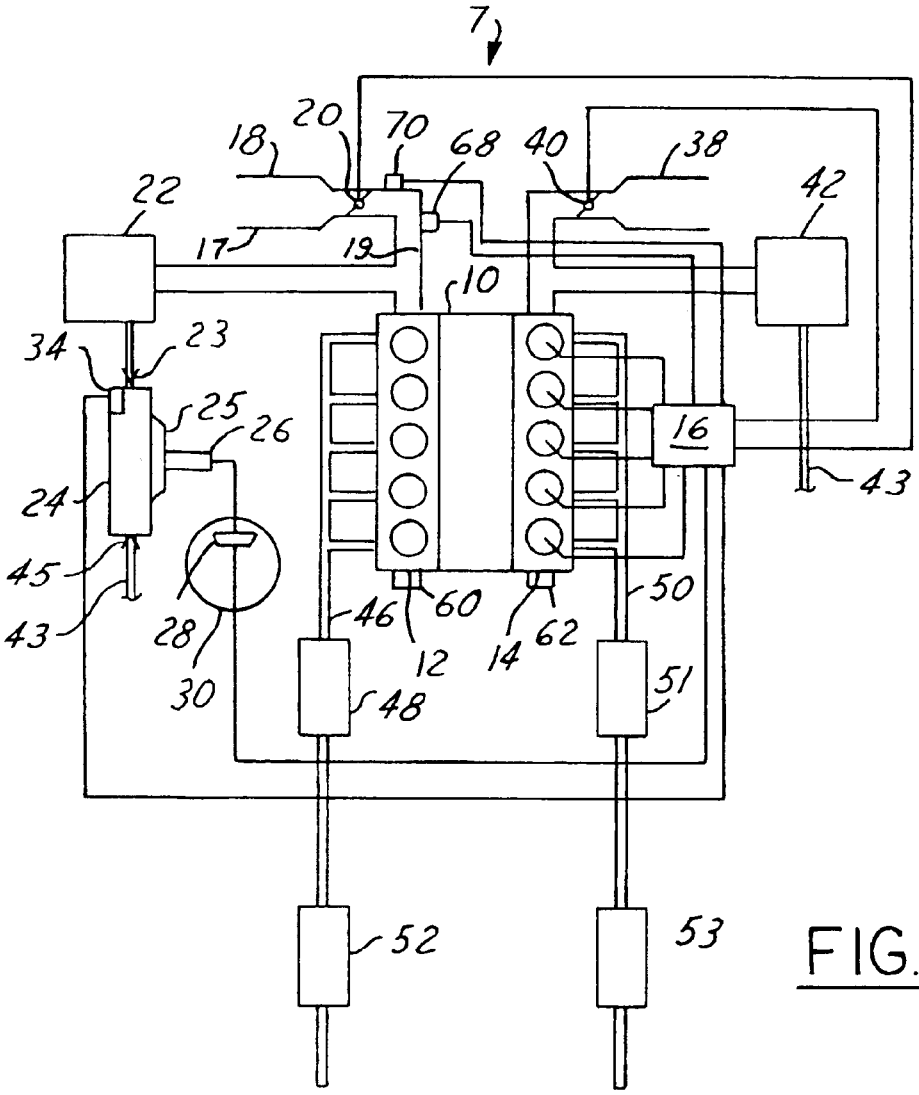
FIG. 1 is a schematic view of a preferred embodiment of the present invention.

Referring to FIG. 1 an arrangement 7 of a vehicle is provided having a variable displacement engine 10. The engine 10 has a first cylinder group 12 and a second cylinder group 14. In other embodiments, the engine may be a straight line engine, or a non-bank firing V-block engine. The engine 10 is a V-block type engine with the first cylinder group 12 included in a left bank and the second cylinder group 14 included in a right bank. The first group of cylinders 12 operate anytime the vehicle is being operated. The second group of cylinders 14 can be totally or individually selectively valve deactivated.

The engine 10 also includes a controller 16. The first group of cylinders has an air intake system which includes a manifold 18 having an independent controlled throttle body 20. The manifold 18 also includes a plenum 22. The plenum 22, through a check valve 23 supplies vacuum to a reservoir 24 of a brake booster 25, for a master cylinder 26. The master cylinder 26 includes a hydraulic cylinder which is utilized to pressurize a brake caliper 28. The brake caliper 28 is utilized to brake a rotating wheel 30.

As is apparent to those skilled in the art, the master cylinder 26 is part of a brake system which is utilized to brake all four or more wheels of the vehicle. Positioned within the vacuum reservoir 24 of the brake booster is a vacuum level sensor 34. The sensor 34 can be an absolute pressure valve sensor or can be a pressure differential type sensor to determine the vacuum level within the reservoir 24.

The sensor 34 generates an electronic signal representative of a vacuum level within the reservoir 24 and delivers such a signal to the controller 16 to make the controller 16 cognizant of the vacuum level within the vacuum system. Operatively associated with the second group of cylinders is a second manifold 38 having an independently controlled throttle body 40. The second manifold 38 also has a second plenum 42.

The first group of cylinders 12 is connected to an exhaust manifold 46. The exhaust manifold 46 passes through a downstream emission control device 48. In a similar manner, the second group of cylinders 14 is connected with an exhaust manifold 50. The exhaust manifold 50 passes through a downstream emission control device 51 which is typically a catalytic converter identical to device 48. A downstream emission control device 52 is provided which accepts emissions from control device 48. A downstream emission control device 53 is provided which accepts emissions from emission control device 51.

A variable cam timing unit 60 is associated with the valves (not shown) of the first group of cylinders 12. The variable cam timing unit 60 allows the timing of the valve opening and/or closing to vary with respect to the position of the engine crankshaft (not shown). In a similar manner, the second group of cylinders 14 has a variable cam timing unit 62. Optionally, the engine 10 may have an exhaust recirculation valve 68 responsive to the controller 16. A manifold pressure sensor 70 may also be included to determine engine mass flow rate. A more detailed explanation of variable cam timing units can be found in U.S. patent application Ser. No. 09/742,207 filed Dec. 20, 2000, commonly assigned.

At the beginning idling operation, the engine controller 16 (which may be a single electronic unit or a network of electronic units that control various electronic functions of the engine and vehicle) will usually signal the second group of cylinders 14 to be deactivated. The cylinders 14 will be deactivated by deactivation of the valves and a cut-off of the fuel injectors (not shown) associated therewith. The actual form of valve deactivation can be along one of several methods as previously mentioned.

Typically, all of the cylinders of the second group of cylinders will be deactivated, however, this need not be the case and the controller can selectively choose to deactivate subgroups or individual cylinders in the second group 14. When only those cylinders in the first group 12 are activated, the engine 10 will essentially operate as an inline 5 engine, typically referred to as an 15. As the power demands of the vehicle increase, the controller 16 will activate the valves associated with the second group of cylinders 14 and the engine 10 will operate as a V10 engine. After a period of acceleration to highway speeds, wherein there is a decrease in power demand of the engine, the controller 16 will selectively signal for deactivation of the cylinders 14.

As mentioned previously, the controller 16 is cognizant of the pressure of the vacuum system by virtue of sensor 34. In certain situations wherein the second group of cylinders 14 are totally or partially deactivated, the controller 16 can become cognizant that the vacuum level of the vacuum system is lower than what is desired. Upon receipt of a signal that the vacuum level is lower than a predetermined level, the controller 16 will command the engine 10 to modify its operation to restore the vacuum level.

One option to restore the vacuum level is to advance the valve timing (sometimes referred to as variable cam timing) of the first group of cylinders 12. If vacuum levels can be restored by advancing the valve timing of the first group of cylinders 12, then the range of engine operation without activation of the second group of cylinders can be prolonged. When looking at optimizing engine performance, or specific power output, a designer of a four-cycle gasoline engine takes into account intended maximum power output and what engine speed (rpm is desired to make the power at. Other engine designer considerations are usable torque range, and engine idle characteristics.

The intake manifold and associated plenum downstream of the throttle can be modeled as a control volume. The inlet to the control volume is a flow restricter provided by the throttle valve which is preferably electronically controlled. The outlet from the manifold is the intake valve (not shown) to the cylinders. Upstream of the throttle valve, is atmospheric pressure (assuming a naturally aspirated engine). In the cylinder, is cylinder pressure. The difference (in air mass flow rate) between the filling of the manifold, via the throttle valve and the emptying of the manifold and plenum, by the pumping action of the pistons moving down in the cylinder is what develops the vacuum in the manifold plenum. Generally, as engine speed increases at a given steady state throttle opening, the air mass flow rate and the cylinder air charge through the engine increase, and the manifold plenum vacuum also increases up to the point where the flow losses through the throttle valve or the inlet valve limit the total air flow.

In effect, the cylinder intake valves are another flow restriction. The important factor in filling the cylinder with air efficiently is the relationship between the valve opening area, and the piston speed (directly related to engine rpm through the ratio on the piston connecting rod length and the crank shaft crank throw). In a non variable cam timing engine designed to meet common everyday use (not a racing or special purpose vehicle), a selection is made of a camshaft and valve timing to maximize the torque at a given rpm, and meet desired power levels, as well as idle stability.

Generally, the intake valve opens before TC (top dead center) on the exhaust stroke, and closes after BC (bottom dead center) on the intake stroke. With early intake valve closing (advance timing), the maximum charging efficiency will lie in the lower engine speed range. With late intake valve closing (retard timing), maximum charging efficiency lies in the upper engine speed range.

Better charging efficiency generates higher torque. Trucks typically have a timing to allow charging efficiency at the low speed range to make a lot of torque at low engine speed for towing. Typically, a sports car has some retard timing to allow for more torque at a higher engine speed and thus more horsepower (note horsepower=torque in ft lbf×rpm/5252). A variable timing engine can change the relationship of valve timing and thus affect the charging efficiency.

Figure 5:
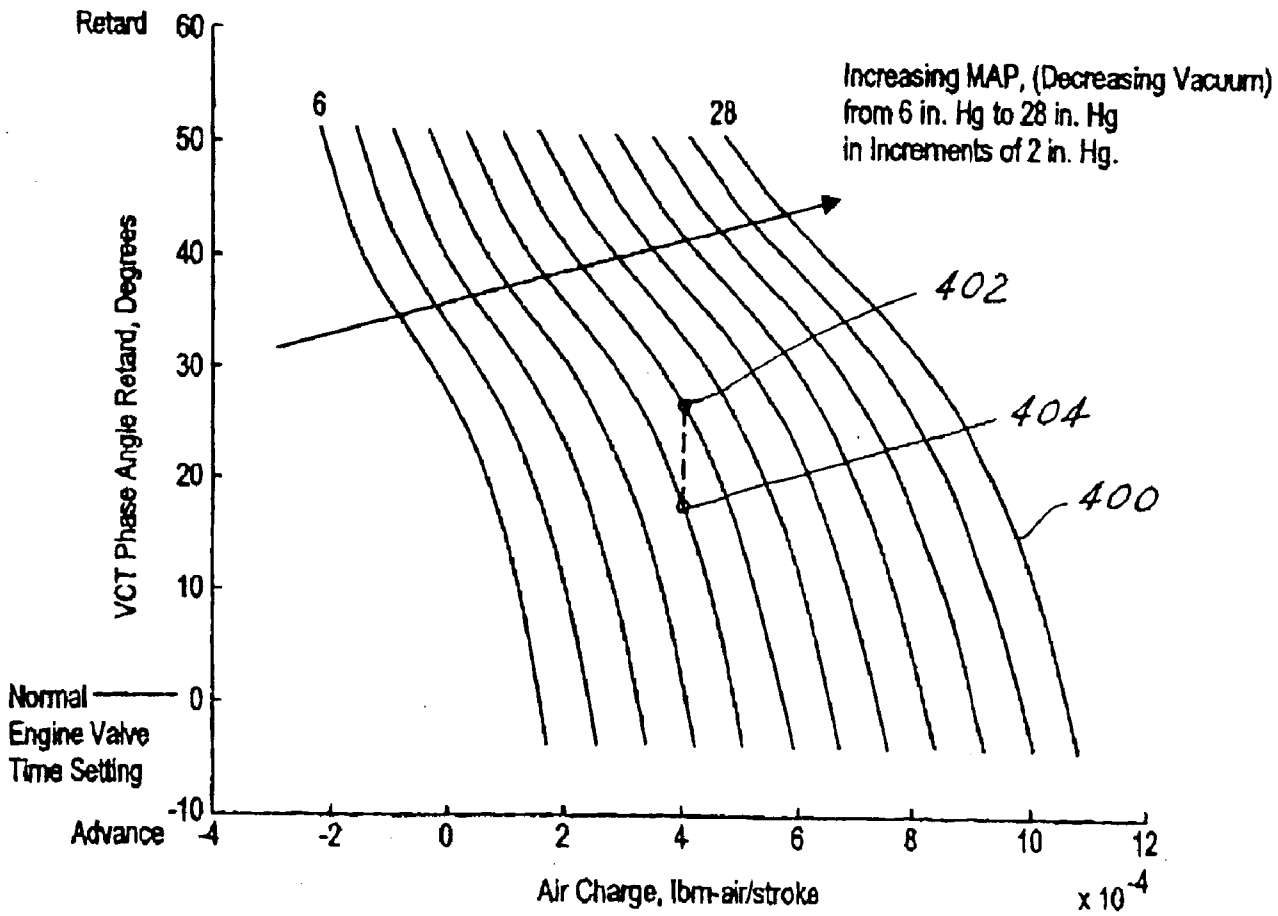
FIG. 5 is a graphic representation illustrating how valve timing and charge per stroke affect manifold absolute pressure.

Referring to FIG. 5, a graph is presented which illustrates relationship between valve time phase angle and air charge per cylinder stroke verses manifold absolute pressure (MAP). The vertical axis of the graph in FIG. 5 illustrates the degree of retardation that the variable cam timing unit phase angle is at.

At zero degrees, the engine is at its pre-selected normal state of valve timing operation. A negative 10 on the Y axis of FIG. 5 means the valve timing has been advanced 10 degrees. A positive 10 means the affect of the valve timing has been retarded 10 degrees. The air charge per cylinder stroke of the X axis is primarily affected by the angle position of the throttle valve. The various lines 400 illustrate MAP from 6 inches mercury to 28 inches mercury to the far right. Since manifold absolute pressure increases from left to right, vacuum increases from right to left.

Looking at data point 402, the air charge is approximately $4\times10^{-4}$ lbs. of air per stroke. The VCT is retarded at this point approximately 27 degrees. The MAP is approximately 16 inches Hg. This correlates to an approximate 14 inches Hg vacuum (vacuum typically equals 30 inches mercury minus MAP). Advancing the valve timing to a point of only 17 degrees of retardation while controlling the throttle to keep a constant 4 lbs. of air per stroke decreases MAP by 2 inches Hg. The decreased MAP corresponds to an increase of vacuum to 16 inches Hg as shown at data point 404.

A more detailed explanation of the relationship between valve timing, throttle valve position and manifold vacuum can be found by a review of Chapter 6 of the book "Internal Combustion Engine Fundamentals"by John B. Heywood, McGraw Hill 1988.

As explained above, the first controller option to restore vacuum level is to advance the timing of the valves associated with the first group of cylinders. Accordingly, the controller 16 will signal to the variable timing unit 60 to advance such timing. In some instances, this will be enough to restore the vacuum level to the level desired. However, in most instances, vacuum level cannot be restored by advancing since the valve timing has to typically already be advanced when the engine 10 is operating as an 15 engine.

In a second option which can, but need not be sequential to the first option, the controller 16 will activate the valves of a single cylinder, a group of cylinders or all of the second group of cylinders 14. The controller will also signal the throttle body 40 to close. The above-noted action will cause the cylinder(s) of the second group 14 to pump air from the manifold 38, which pumping increases the vacuum level within the plenum 42. The plenum 42, by virtue of connection with the check valve (not shown), can also be connected with the vacuum reservoir 24.

If the vacuum level is still not enough, it can be further increased by actuating the injectors and ignition system which are connected with one, a group of or all of the second group of cylinders 14 to increase the vacuum level by firing the cylinders. The operation of the engine 10 to increase vacuum levels will be integrated with other factors which control engine operation, including control of the catalyst and emission systems as described in U.S. patent application Ser. No. 09/732,269, filed Dec. 7, 2000, commonly assigned. As mentioned, the controller 16 need not be sequential in this operation but can go directly to one of the aforementioned options based upon its logic of operation.

Figure 2:
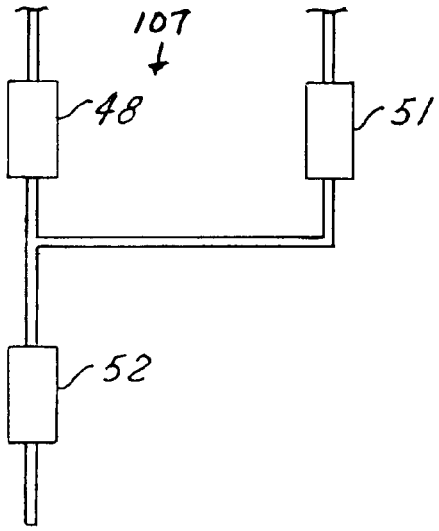
FIG. 2 is a partial view of an alternate preferred embodiment of the present invention.

Referring to FIG. 2 with like components being given identical reference numerals, an arrangement 107 with an exhaust system having two upper stream converters 48 and 51 and one common downstream converter 52 is shown. In this configuration, the second option of pumping air is typically not utilized to prevent excess air from reaching the converter 52. Accordingly, the converter will be configured to proceed from the first option of camshaft timing advance to firing a cylinder or cylinders of the second group.

Figure 3:
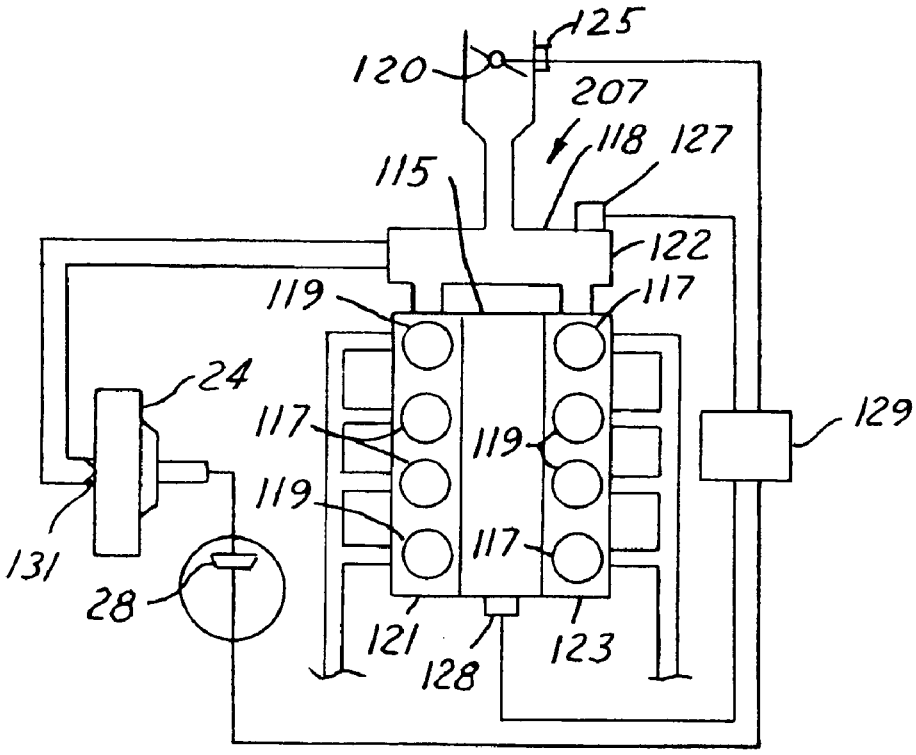
FIG. 3 is a partial view of another alternate preferred embodiment of the present invention.

Referring to FIG. 3, an arrangement 207 is provided having a single manifold 118, V8 non bank-to-bank fired engine 115. The manifold 118 has a single throttle body 120 and a single plenum 122. The engine has a first group of cylinders 117 and a second group 119. Both groups of cylinders are on both cylinder banks 121 and 123.

The vacuum level in the brake reservoir 224 is inferred by a combination of engine operation parameters and by brake system operation history. A sensor 127 is provided to determine vacuum level in the plenum. The sensor 127 provides a signal to a controller 129. The controller 129 is additionally aware of the throttle position 120 from a throttle position sensor 125 and the engine rpm from a RPM sensor 128. Throttle positionaids is combined with engine rpm to determine engine mass flow rate. in determining mass flow rate and by determining the manifold pressure, throttle position, engine rpm and a pressure setting of check valve 131, a determination can be made to Mass flow rate and manifold pressure are integrated over time to determine vacuum available. This is compared with the setting of the check valve 131 to determine the maximum available vacuum within the brake booster reservoir 24. The maximum vacuum available is then reduced based upon brake system history to determine a present value for vacuum availability.

When the controller 129 determines that the vacuum level available is below a predetermined value, a signal will modify engine operation to increase the vacuum level. If the engine arrangement 207 has variable cam timing on both cylinder banks, the controller will typically first signal for an increase in cam advance. However, in most instances, the preferred methodology will be to fire some or all of the second group of cylinders 119. Although the second option of using the second group of cylinders to pump air is typically not advantageous, the arrangement 207 by having a single plenum 122 provides reduction in cost of the vehicle.

Figure 4:
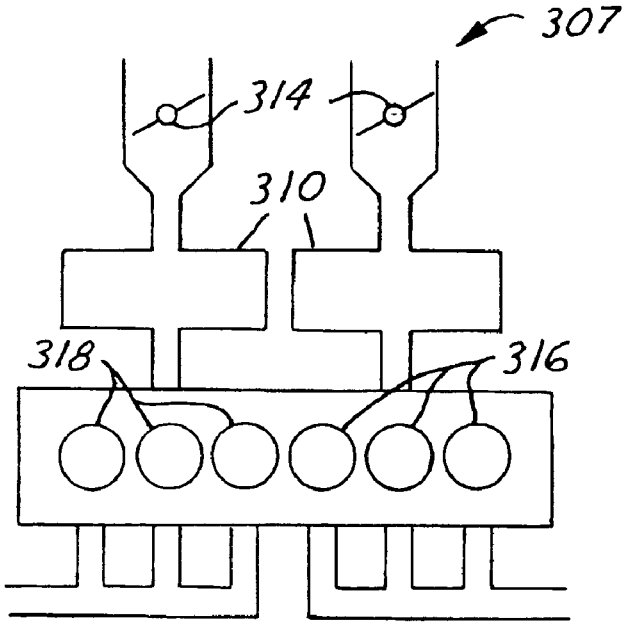
FIG. 4 is a schematic view of still another alternate preferred embodiment of the present invention.

FIG. 4 shows another embodiment of the present invention utilized on inline 6 or V6 type engines. The present invention is also applicable for various piston engine formats such as a V-12, inline 4, inline 5, horizontally opposed and "W" configurations. As shown in FIG. 4, an inline 6 engine arrangement 307 could have two intake manifolds 310. Each manifold 310 could be controlled by an electronic throttle 314. Each manifold would supply three cylinders 318. A second group of cylinders 316 would be capable of deactivation. The first group of three cylinders 318 would not be deactivatable.

The present invention has been explained in various embodiments, however, it be evident to those skilled in the art the various modifications and changes can be made to the invention without departing from the spirit and scope of the invention as it is defined by the appended claims.

What is claimed is:

1. A vehicle variable displacement internal combustion engine arrangement comprising:

a first group of cylinders;

a second selectively deactivatable group of cylinders;

a manifold exposed to at least one of said group of cylinders;

a vacuum system communicating with said manifold; and an engine controller cognizant of a vacuum level of said vacuum system, said controller modifying operation of said engine to increase a vacuum level of said manifold when said second group of cylinders is deactivated and said vacuum system vacuum level is lower than a predetermined level.

2. An arrangement as described in claim 1, wherein said engine is made cognizant of said vacuum system vacuum level by a sensor of said vacuum system.

3. An arrangement as described in claim 1, wherein said controller is cognizant of said vacuum system vacuum level by implication from an operational parameter of said engine.

4. An arrangement as described in claim 1, wherein said controller is cognizant of said vacuum system vacuum level by a signal representation of an operational history of a brake system of said vehicle.

5. An arrangement as described in claim 1, wherein said engine additionally has variable cam timing and wherein said controller signals said first group of cylinders to advance said cam timing to increase said vacuum level of said vacuum system.

6. An arrangement as described in claim 1, wherein said controller activates at least one valve of a cylinder of said second group of cylinders to cause said cylinder to pump air from said manifold to increase said vacuum level of said vacuum system.

7. An arrangement as described in claim 6, wherein said engine controller additionally fires said activated cylinder of said second group of cylinders.

8. An arrangement as described in claim 5, wherein said controller can progressively cause said first group of cylinders to advance cam timing and then cause said second group of cylinders to activate a cylinder to pump air from said manifold and can then cause said activated cylinder of said second group of cylinders to be fired to increase said vacuum level of said vacuum system.

9. An arrangement as described in claim 1, wherein said controller has options to increase the vacuum level of said vacuum system, said options including:

advancing the variable cam timing of said first group of cylinders;

activating a cylinder of said second group of cylinders to pump air from said manifold;

and wherein said controller can progressively select at one of said options to increase the vacuum level of said vacuum system.

10. An arrangement as described in claim 1, wherein said controller can increase the vacuum level of said vacuum system by advancing the variable cam timing of said first group of cylinders; and by activating a cylinder of said second group of cylinders to pump air from said manifold.

11. An arrangement as described in claim 1, wherein said controller can increase the vacuum level of said vacuum system by advancing the variable cam timing of said first group of cylinder; and by firing a cylinder of said second group of cylinders.

12. An arrangement as described in claim 1, wherein said controller can increase the vacuum level of said vacuum system by activating a cylinder of said second group of cylinders to pump air from said manifold; and by firing said activated cylinder of said second group of cylinders.

13. An arrangement as described in claim 1, wherein said controller can increase the vacuum level of said vacuum system by advancing the variable cam timing of said first group of cylinders by activating a cylinder of said second group of cylinders to pump air from said manifold; and by firing said activated cylinder of said second group of cylinders.

14. An arrangement as described in claim 1, wherein said controller has options to increase the vacuum level of said vacuum system, said options including:

advancing the variable cam timing of said first group of cylinders;

activating a cylinder of said second group of cylinders to pump air from said manifold;

and wherein said controller can nonsequentially select one of said options to increase the vacuum level of said vacuum system.

15. An arrangement as described in claim 1, wherein said controller has options to increase the vacuum level of said vacuum system, said options including:

advancing the variable cam timing of said first group of cylinder; and firing a cylinder of said second group of cylinders;

and wherein said controller can nonsequentially select one of said options to increase the vacuum level of said vacuum system.

16. An arrangement as described in claim 1, wherein said controller has options to increase the vacuum level of said vacuum system, said options including:

activating a cylinder of said second group of cylinders to pump air from said manifold;

firing said activated cylinder of said second group of cylinders, and wherein said controller can nonsequentially select one of said options to increase the vacuum level of said vacuum system.

17. An arrangement as described in claim 1, wherein said controller has options to increase the vacuum level of said vacuum system, said options including:

advancing the variable cam timing of said first group of cylinders;

activating a cylinder of said second group of cylinders to pump air from said manifold; and firing said activated cylinder of said second group of cylinders, and wherein said controller can nonsequentially select one of said options to increase the vacuum level of said vacuum system.

18. An arrangement as described in claim 1, wherein said first group of cylinders and said second group of cylinders have separate manifolds.

19. An arrangement as described in claim 1, wherein said first group of cylinders and said second group of cylinders have a common exhaust.

20. An arrangement as described in claim 1, wherein said first group of cylinders and said second group of cylinders have separate exhausts.

21. An arrangement as described in claim 1, wherein said engine is a V block type engine and said first group of cylinders and said second group of cylinders are on opposite banks.

22. An arrangement as described in claim 1, wherein said engine is a V block type engine and said first group of cylinders and said second group of cylinders are on common banks.

23. An arrangement as described in claim 1, wherein said engine is an inline engine.

24. An arrangement as described in claim 6, wherein there is a plurality of cylinders in said second group of cylinders and said controller can selectively determine a number of cylinders of said second group to be activated to increase said vacuum system vacuum level.

25. An arrangement as described in claim 7, wherein there is a plurality of cylinders in said second group of cylinders and said controller can selectively determine a number of said cylinders in said second group to increase said vacuum system vacuum level.

26. A vehicle reciprocating piston, variable displacement internal combustion engine arrangement comprising:

a first group of cylinders;

a second selectively deactivatable group of cylinders;

a first throttled manifold exposed to at least one of said first group of cylinders;

a second independently throttled manifold exposed to said second group of cylinders;

a vacuum system communicating with said first and second manifolds, and an engine controller cognizant of a vacuum level of said vacuum system, said controller modifying operation of said engine to increase a vacuum level of said vacuum system by firing a cylinder of said second group when said second group of cylinders is deactivated and said vacuum system vacuum level is lower than a predetermined level.

27. A method of operating an arrangement of a vehicle having a variable displacement internal combustion engine which additionally powers a vacuum system, said engine including a first group of cylinders and a second group of cylinders which may be selectively deactivated when a power demand for said engine is below a predetermined valve, said method comprising:

operating said first group of cylinders to power said vehicle;

connecting said vacuum system with a manifold supplying air to said engine;

fluidly exposing said manifold to one or more of said groups of cylinders;

signaling an engine controller of a vacuum level of said vacuum system; and controlling said engine to increase a vacuum level of said manifold when said vacuum level is lower than a predetermined level and said second group of cylinders is deactivated.

28. A method as described in claim 27, additionally comprising:

sensing the actual vacuum level within said vacuum system and delivering to said engine controller a signal representative of said vacuum system vacuum level.

29. A method of operating an engine as described in claim 27, further including, inferring a vacuum level of said vacuum system based upon an operational parameter of said engine.

30. A method of operating an engine as described in claim 27, wherein the method of determining the vacuum level within said vacuum system is based upon a signal which reflects an operational history of a vacuum powered brake system of said vehicle.

31. A method of operating an engine as described in claim 27, wherein the engine additionally has variable cam timing and the timing of the cam is advanced in the first group of cylinders to increase a vacuum level of said vacuum system.

32. A method of operating an engine as described in claim 27, wherein at least one cylinder of said second group of cylinders is activated to pump air from manifold to increase a vacuum level of said vacuum system.

33. A method of operating an engine as described in claim 32, wherein said cylinder of said second cylinder group which is activated is also fired.

34. A method of operating an engine as described in claim 27, wherein said engine can progressively activate a cylinder to pump air from said manifold and then activate said cylinder to fire.

35. A method of operating an engine as described in claim 27, wherein the said engine can selectively advance variable cam timing of said first group of cylinders and thereinafter can additionally, progressively reactivate a cylinder of said second group of cylinders and can then additionally fire said cylinder of said second group of cylinders.

36. A method of operating an engine as described in claim 27, wherein the engine can select an option to advance a variable cam timing of said first group of cylinders and said engine can select an option to reactivate a cylinder of said second group of cylinders to pump air from said manifold and wherein said engine can select from one of said two options based upon a vacuum level of said vacuum system.

37. A method of operating a vehicle engine as described in claim 27, wherein the engine can select an option to advance a variable cam timing of said first group of cylinders and said engine can select an option to fire a cylinder from said second group of cylinders and wherein said engine can select from one of said options based upon a vacuum level of said vacuum system.

38. A method of operating a vehicle engine as described in claim 27, wherein the engine can select an option of reactivating a cylinder of said second group of cylinders to pump air from said manifold and an option firing a cylinder from said second group of cylinders and wherein said engine can select from one of said options based upon a vacuum level of said vacuum system.

39. A method of operating a vehicle engine as described in claim 27, wherein the engine can select an option of advancing a variable cam timing of said first group of cylinders and the engine can select an option to reactivate a cylinder of said second group of cylinders to pump air from said manifold and said engine can select an option to fire a cylinder from said second group of cylinders and wherein the engine can select from one of said options based upon a vacuum level of said vacuum system.

* * * * *